United States Patent [19]

Abraham

[11] 4,370,866

[45] Feb. 1, 1983

[54] REMOVABLE DUCT PANEL FOR MULTIBAND REFRIGERATED DISPLAY CASES

[75] Inventor: Fayez F. Abraham, Niles, Mich.

[73] Assignee: Tyler Refrigeration Corporation, Niles, Mich.

[21] Appl. No.: 221,375

[22] Filed: Dec. 30, 1980

Related U.S. Application Data

[63] Continuation of Ser. No. 76,568, Sep. 18, 1979, abandoned.

[51] Int. Cl.[3] ..... A47F 3/04

[52] U.S. Cl. ..... 62/256

[58] Field of Search ..... 62/256

[56] References Cited

U.S. PATENT DOCUMENTS

| | | | |
|---|---|---|---|
| 2,463,614 | 3/1949 | Hardin | 62/256 X |
| 2,508,255 | 5/1950 | Hardin | 62/256 |
| 2,513,675 | 7/1950 | Quillen | 62/256 |
| 3,561,230 | 2/1971 | Gatton et al. | 62/256 |
| 3,675,440 | 7/1972 | Ibrahim | 62/256 X |
| 4,144,720 | 3/1979 | Subera et al. | 62/256 |

*Primary Examiner*—Lloyd L. King

*Attorney, Agent, or Firm*—LeBlanc, Nolan, Shur & Nies

[57] ABSTRACT

A multiband refrigerated display case having: an outer cabinet, an inner cabinet having an open product display space therein, and a divider between the inner and outer cabinets for dividing the space between the cabinets into adjacent first and second conduits. The divider comprises a first relatively fixed bottom panel member and a second removable panel member. The first bottom panel member has a U-shaped region for loosely receiving one end portion of the second panel member. Support legs are located on the underside of the second panel member for supporting the second panel member on the bottom portion of the outer cabinet in spaced relation thereto. Inlet grill means are loosely supported on the second panel in a position to cover the first and second conduit inlets; and a removable bottom shelf defining the bottom of the inner cabinet and display space is loosely supported on the removable second panel.

6 Claims, 2 Drawing Figures

REMOVABLE DUCT PANEL FOR MULTIBAND REFRIGERATED DISPLAY CASES

This is a continuation of application Ser. No. 76,568, filed Sept. 18, 1979, now abandoned.

BACKGROUND OF THE INVENTION

This invention relates to refrigerated display cases, and more particularly to open display cases having multiple air bands flowing across the access opening of the case. Still more particularly, the invention is directed to a case having easily removable panels in the storage display section.

This invention is primarily, but not exclusively, directed to refrigerated display cases of the type usually found in supermarkets, convenience stores, etc. One popular case style has an open product display area protected by one or more air bands circulated across the customer access opening. Such cases may either be of the open top type, as shown in U.S. Pat. No. 4,106,305, issued to Fayez Abraham and assigned to Tyler Refrigeration Corporation, or the open front type, as shown, for example, in U.S. Pat. No. 4,144,720 issued to Elmer Subera, Melvin Steelman, and Fayez Abraham, and assigned to Tyler Refrigeration Corporation.

It should be noted that throughout this disclosure, except where specifically indicated otherwise, the term "refrigerated case" refers to medium temperature cases (e.g. case temperatures maintained in the 32°-50° F. range) and low temperature freezer cases (case temperature maintained below 32° F.).

Commerical refrigerated display cases must be maintained with a high degree of cleanliness, both to meet local health code requirements and to present a favorable appearance to the customer. Thus the display cases, and particularly the product storage area, must be cleaned at frequent intervals. Cases which are used for the storage and display of certain types of goods, particularly including meat and poultry products and vegetable products, which are generally of the medium temperature type, generally require more frequent cleanings than, for example, dairy cases and frozen food display cases.

In the past, cleaning the display case was a difficult chore, often requiring the services of trained maintenance personnel to dismantle at least a portion of the case so that the area underneath the bottom display shelf could be cleaned. Heretofore, display cases were constructed in such a way that it was necessary to unbolt or unscrew a number of parts including, for example, the bottom display shelf and the intermediate duct separator panel in order to get access to the main case drain or waste outlet. Such access is necessary, particularly in meat or poultry cases, to clean blood or other juices which leak from the packages and collect in areas underneath the display shelf.

It is an object of the present invention to provide a case construction which permits ready access to the portion of the case below the display area.

A further object is to provide a construction which permits ready access to the waste outlet area beneath the case for cleaning and/or clearing of the outlet.

A further object is to provide a case construction which enables portions of the display case to be readily removed without special tools.

SUMMARY OF THE INVENTION

A multiband refrigerated display case having: an outer cabinet, an inner cabinet having an open product display space therein, and a divider between the inner and outer cabinets for dividing the space between the cabinets into adjacent first and second conduits. The divider comprises a first relatively fixed bottom panel member and a second removable panel member. The first bottom panel member has a U-shaped region for loosely receiving one end portion of the second panel member. Support legs are located on the underside of the second panel member for supporting the second panel member on the bottom portion of the outer cabinet in spaced relation thereto. Inlet grill means are loosely supported on the second panel in a position to cover the first and second conduit inlets; and a removable bottom shelf defining the bottom of the inner cabinet and display space is loosely supported on the removable second panel.

More particularly, the second removable panel member comprises a main body portion contiguous with and at an angle to the one end portion and an opposite end position extending from the main body portion at an angel thereto. The grill support comprises a plurality of members secured to the upper surfaces of the main body portion and the opposite end portion of the second panel member and has substantially L-shaped grill support faces. The inlet has a substantially complementary L-shaped portion adapted to seat loosely on the L-shaped grill support faces. The removable bottom shelf is supported by a lip extending from the inlet grill into the display space when the inlet grill is in its operative position resting on the grill support; the inner cabinet has an opposed lip for supporting an opposite edge portion of the removable bottom shelf.

DESCRIPTION OF PREFERRED EMBODIMENT(S)

Figure 1:
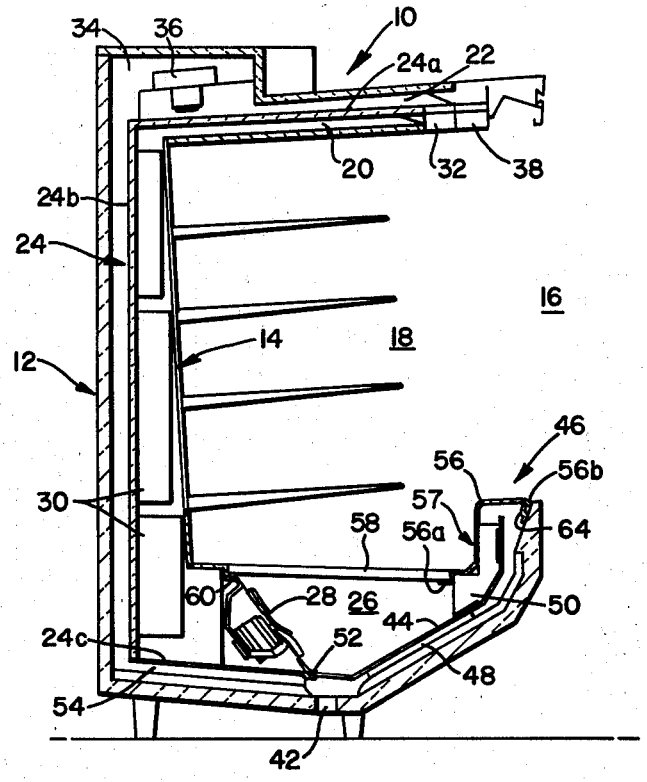
FIG. 1 shows a side sectional view of an open front refrigerated display case incorporating features of this invention.

FIG. 1 shows an open front refrigerated display case 10 having an outer cabinet 12 and an inner cabinet 14, each having an open front which are aligned to define a customer access opening 16 to a product display/storage section 18 defined within inner cabinet 14. The space between the outer cabinet 12 and inner cabinet 14 is preferably and advantageously divided into an inner air conduit 20 and outer air conduit 22 by an intermediate divider generally designated 24.

The inner conduit 20 is comprised in part of a plenum 26 containing one or more primary band fans 28. One or more sets of evaporator coils 30 are located in the primary band conduit 20 downstream (in the direction of refrigerated air flow) of the fans 28. The coils 30 are preferably and advantageously connected to centrally located refrigeration machinery, in a manner well known in the art. An outlet grid 32, preferably and advantageously of the honeycomb type, is located at the outlet of primary band conduit 20 to direct air flow across the access opening 16 (downwardly in the case of the open front display cabinet shown in the drawing).

The outer conduit 22 comprises, in part, a plenum 34 containing one or more air propelling fans 36. A grid 38, which may be similar to or an extention of honeycomb grid 32, is located at the outlet of conduit 22 to direct air across the access opening 16.

As shown in FIG. 1, the bottom portion of the refrigerated case 10 slopes downwardly toward a relatively centrally located drain region 40 in which is located a waste outlet drain 42.

The primary-secondary conduit divider 24 comprised a top member 24*a*, a back member 24*b* and a bottom member 24*c* contiguous with each other. Portions 24*a* and 24*b* may advantageously and preferably be insulated to minimize heat transfer between the relatively cold air in conduit 20 downstream of the evaporators 30 and the relatively warmer unrefrigerated air in conduit 22. A removable duct separator panel 44 also comprising part of divider 24, extends forwardly and upwardly from member 24*c* toward an air inlet region 46.

Figure 2:
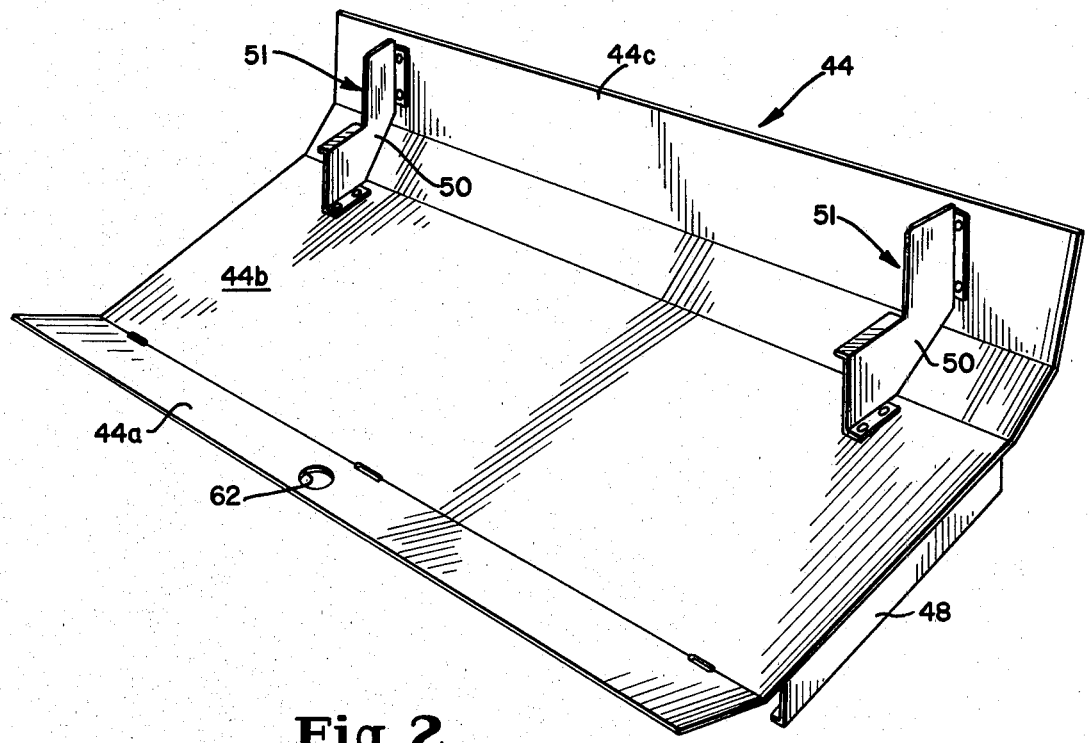
FIG. 2 is a perspective view of the removable duct separator panel of this invention.

As shown in more detail in FIG. 2, separator panel 44 comprises a leading edge portion 44*a*, a main body portion 44*b*, and a generally upwardly extending trailing edge portion 44*c*; section 44*c* may have an intermediate bend as shown and as necessary to conform to the desired shape of the ducts. Leg members 48 (only one being shown) mount securely to the unside of panel section 44*b*. A plurality of grid support members 50 (two of which are shown in FIG. 2) preferably and advantageously mount to the upper surfaces of panel sections 44*b* and 44*c*. Support members 50 preferably have substantially L-shaped support faces 51.

The foward edge of bottom member 24*c* preferably and advantageously comprises a U-shaped region 52. This U-shaped region 52 may comprise a stamped integral part of the member 24*c* or may be a separate part rigidly secured by welding or riveting, to the end of member 24*c*. Also member 24*c* is securely fixed to and spaced from the bottom of the cabinet defining the outer wall of conduit 22 by means of legs 54 which may be similar to legs 48 supporting panel 44. Preferably, legs 54 are secured to both the panel member 24*c* and to the case bottom.

The leading edge 44*a* of separator panel 44 seats in a grove formed by the legs of U-shaped region 52. Panel 44 is supported on and in spaced relation from the upwardly extending front portion of outer cabinet 12 by legs 48. Thus the inlet region of the outer or secondary band conduit 22 is defined between the panel 44 and upwardly extending front portion of cabinet 12.

An air return grill 56, having a region 57 which is substantially L-shaped complementary to L-shaped portions 51 of support members 50, extends inwardly from the lower front edge of cabinet 12 and rests on the grill support members 50. Inlet grill 56 has one edge or lip portion 56*a* which extends slightly into the display region of the case at the bottom. A removable bottom display section shelf 58 rests on this lip 56*a* at its forward end. The rear edge of shelf 58 is supported in any known manner, such as by a corresponding lip 60, advantageously forming an integral part of the bottom portion of inner cabinet 14. Preferably and advantageously, grill 56 is not secured in any way to the cabinet 12 or support member 50; preferably gill 56 merely rests on support member 50 and is held in place by the weight of shelf 58.

Access to the inside bottom of cabinet 12, and particularly to the drain region 40 and drain outlet 42, may be had quickly and easily, as follows: bottom shelf 58 is lifted off its supports 56*a* and 60. Inlet grill 56 may then be lifted off support members 50. Finally, separator panel 44 is then pulled forwardly and upwardly to useat leading edge 44*a* from the grove of U-shaped region 52. Upon removal of panel 44, the entire drain region 40 is freely accessible e.g. for cleaning. Replacement of the various members is accomplished by reversing the steps outlined above to thereby return the case to its normal operating condition.

Panel 44 may, if desired, contain an opening 62, advantageously and preferably located over the drain outlet 42. Such opening will permit visual access to the drain outlet by only removing bottom shelf 58, without also requiring removal of the inlet grill 56 and separator panel 44.

When removable shelf 58 is resting on lips 56*a* and 60, the weight of shelf 58, particularly with food products resting thereon, exerts a force on lip 56*a* which would tend to cause inlet grill 56 to rotate inwardly and thereby cause shelf 58 to collapse. To prevent such rotation while still enabling grill 56 to be easily removed, one or more locking blocks 64 may be provided on the inner face of the outer cabinet 12 adjacent inlet region 46. A downwardly turned end portion 56*b* of inlet grill 56 mates with locking member 64 in a tongue and groove arrangement. In this manner the locking members 64 inhibit movement of the inlet grill 56 toward the interior of the display space into the storage/display section 18 while permiting relatively vertical upward movement of the grill 56 for removability.

For convenience, the novel and advantageous features of this invention have been described with respect to an open front refrigerated case. It should be noted, however, that the invention may also be applicable to multiband open top cases of the type described, for example, in the present inventor's co-pending application Ser. No. 11,804, filed Feb. 14, 1979, now abandoned and assigned to Tyler Refrigeration Corporation.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A refrigerated display case comprising:

an outer cabinet having a bottom portion which slopes downwardly to form a drain region for collecting fluid material by gravity flow;

an inner cabinet within said outer cbinet and spaced therefrom, said inner cabinet having a product display space therein, said inner and outer cabinets having aligned access openings to permit access to the display space in the inner cabinet;

means intermediate said inner and outer cabinets for dividing the space between said cabinets into adjacent first and second conduits, each conduit having respective outlets and inlets on opposite sides of the aligned cabinet access openings, wherein said intermediate means for dividing the space between the inner and outer cabinets comprises a first relatively fixed bottom panel member and a second removable panel member;

air circulating means for propelling air through said first and second conduits between their respective inlets and outlets and across the aligned access openings between the respective conduit outlets and inlets;

means for refrigerating the air flowing through at least one of the first and second conduits;

means at one end region of the first bottom panel member for loosely receiving therein one end portion of the second panel member;

support means located on the underside of the second panel member for supporting said second panel member on the bottom portion of the outer cabinet in spaced relation thereto;

inlet grill means;

grill support means for loosely supporting said inlet grill means in a position to cover the first and second conduit inlets; and a removable bottom shelf defining the bottom of the inner cabinet and display space;

said inlet grill means including means for loosely supporting at least a portion of the removable bottom shelf.

2. Display case according to claim 1, wherein said means for loosely receiving one end portion of a second panel comprises a substantially U-shaped portion extending from one end of the first bottom panel member, said second panel member end portion being slidably receivable in the groove of the U-shaped portion.

3. A display case according to claim 1 or 2, further comprising means secured to the outer cabinet adjacent to the conduit inlets for restraining the inlet grill means against relatively lateral inward movement toward and into the display space while freely permitting upward relatively vertical upward movement of the inlet grill means.

4. A display case according to claim 1 or 2, wherein said second panel member includes means permitting visual observation of said drain region without removing said second panel member from its operational position loosely received by said first bottom panel member.

5. A display case according to claim 4, wherein said means permitting visual observation of the drain region comprises at least one through opening located in said one end portion of the second panel member.

6. A display case according to claim 1 or 2, wherein:

said second removable panel member comprises a main body portion contiugous with and at an angle to said one end portion and an opposite end portion extending from said main body portion at an angle thereto;

said grill support means comprises a plurality of members secured to the upper surfaces of said main body portion and said opposite end portion of said second panel member and having substantially L-shaped grill support faces;

said inlet grill means has a substantially complementary L-shaped portion adapted to seat loosely on said L-shaped grill support faces;

said means for loosely supporting at least a portion of the removable bottom shelf comprises a lip extending from the inlet grill means into the display space when the inlet grill means is in its operative position resting on said grill support mean; and said inner cabinet has an opposed lip for supporting an opposite edge portion of the removable bottom shelf.

* * * * *

UNITED STATES PATENT AND TRADEMARK OFFICE

CERTIFICATE OF CORRECTION

PATENT NO. : 4,370,866

DATED : February 1, 1983

INVENTOR(S) : Fayez F. Ibrahim

It is certified that error appears in the above-identified patent and that said Letters Patent are hereby corrected as shown below:

On the title page;
Front page, change "Abraham" in both occurrences to --Ibrahim--.
Column 1, line 22, change "Abraham" to --Ibrahim--.
Column 1, line 25, change "Abraham" to --Ibrahim--.
Column 2, line 25, change "angel" to --angle--.
Column 3, line 32, change "foward" to --forward--.
Column 3, line 63, change "gill" to --grill--.
Column 4, line 3, change "useat" to --unseat--.
Column 4, line 29, change "permiting" to --permitting--.
Column 5, line 34, delete "upward".
Column 6, line 14, change "contiugous" to --contiguous--.

Signed and Sealed this

*Thirteenth* Day of *August 1985*

[SEAL]

*Attest:*

DONALD J. QUIGG

*Attesting Officer* *Acting Commissioner of Patents and Trademarks*